US009409410B2

(12) United States Patent
Sawase

(10) Patent No.: US 9,409,410 B2
(45) Date of Patent: Aug. 9, 2016

(54) IMAGE FORMING APPARATUS AND NON-TRANSITORY COMPUTER READABLE MEDIUM

(71) Applicant: Hiroshi Sawase, Kanagawa (JP)

(72) Inventor: Hiroshi Sawase, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/878,164

(22) Filed: Oct. 8, 2015

(65) Prior Publication Data

US 2016/0101629 A1 Apr. 14, 2016

(30) Foreign Application Priority Data

Oct. 10, 2014 (JP) ..... 2014-209418
Apr. 13, 2015 (JP) ..... 2015-081781

(51) Int. Cl.
*B41J 2/175* (2006.01)

(52) U.S. Cl.
CPC ..... *B41J 2/17566* (2013.01)

(58) Field of Classification Search
CPC ..... B41J 2/17566; B41J 2/175; B41J 2002/17589; B41J 2/04501
See application file for complete search history.

(56) References Cited

U.S. PATENT DOCUMENTS

2011/0063344 A1 3/2011 Satoh et al.
2012/0139979 A1 6/2012 Tokuno
2013/0222460 A1 8/2013 Sawase
2013/0286065 A1* 10/2013 Uetsuki ..... B41J 2/17566 347/7

FOREIGN PATENT DOCUMENTS

JP 2011-079292 4/2011
JP 2011-183729 9/2011
JP 2012-121145 6/2012
JP 2013-139155 7/2013

* cited by examiner

*Primary Examiner* — Thinh Nguyen
(74) *Attorney, Agent, or Firm* — Cooper & Dunham LLP

(57) ABSTRACT

An image forming apparatus includes a recording head, a head tank, a main tank, and a controller. The recording head includes nozzles to discharge liquid droplets. The head tank includes a liquid containing part to contain liquid supplied to the recording head. The main tank contains the liquid supplied to the head tank. The controller controls, after detection of an end state of the main tank, post-end printing using the liquid remaining in the head tank corresponding to the main tank in the end state. The controller permits the post-end printing when an amount of the liquid remaining in the head tank to which the liquid is supplied from the main tank in the end state is a predetermined threshold remaining amount or greater.

10 Claims, 16 Drawing Sheets

IMAGE FORMING APPARATUS AND NON-TRANSITORY COMPUTER READABLE MEDIUM

CROSS-REFERENCE TO RELATED APPLICATIONS

This patent application is based on and claims priority pursuant to 35 U.S.C. §119(a) to Japanese Patent Application Nos. 2014-209418, filed on Oct. 10, 2014, and 2015-081781, filed on Apr. 13, 2015, in the Japan Patent Office, the entire disclosure of each of which is hereby incorporated by reference herein.

BACKGROUND

1. Technical Field

Aspects of this disclosure relate to an image forming apparatus and a non-transitory computer readable medium storing a program to cause a computer to execute a process for the image forming apparatus.

2. Description of the Related Art

An image forming apparatus may have a liquid discharge head (droplet discharge head) serving as a recording head to discharge droplets and a main tank (e.g., ink cartridge) to store liquid supplied to the liquid discharge head. Such an image forming apparatus may permit post-end printing using residual liquid in the head tank after it is determined that the main tank is in an end state.

However, for example, in a configuration in which post-end printing in an end state of an ink cartridge is allowable by a user's operation, post-end printing may be started even when the amount of ink remaining in a head tank of a recording head is not sufficient.

SUMMARY

In an aspect of this disclosure, there is provided an image forming apparatus that includes a recording head, a head tank, a main tank, and a controller. The recording head includes nozzles to discharge liquid droplets. The head tank includes a liquid containing part to contain liquid supplied to the recording head. The main tank contains the liquid supplied to the head tank. The controller controls, after detection of an end state of the main tank, post-end printing using the liquid remaining in the head tank corresponding to the main tank in the end state. The controller permits the post-end printing when an amount of the liquid remaining in the head tank to which the liquid is supplied from the main tank in the end state is a predetermined threshold remaining amount or greater.

In another aspect of this disclosure, there is provided a non-transitory computer readable medium that stores a program to cause a computer to execute a process for an image forming apparatus including a liquid discharge head including nozzles to discharge liquid droplets, a head tank including a liquid containing part to contain liquid supplied to the liquid discharge head, and a main tank to contain the liquid supplied to the head tank. The process includes controlling, after detection of an end state of the main tank, post-end printing using the liquid remaining in the head tank corresponding to the main tank in the end state, and permitting the post-end printing when an amount of the liquid remaining in the head tank to which the liquid is supplied from the main tank in the end state is a predetermined threshold remaining amount or greater.

BRIEF DESCRIPTION OF THE SEVERAL VIEWS OF THE DRAWINGS

The aforementioned and other aspects, features, and advantages of the present disclosure would be better understood by reference to the following detailed description when considered in connection with the accompanying drawings, wherein.

Figure 1:
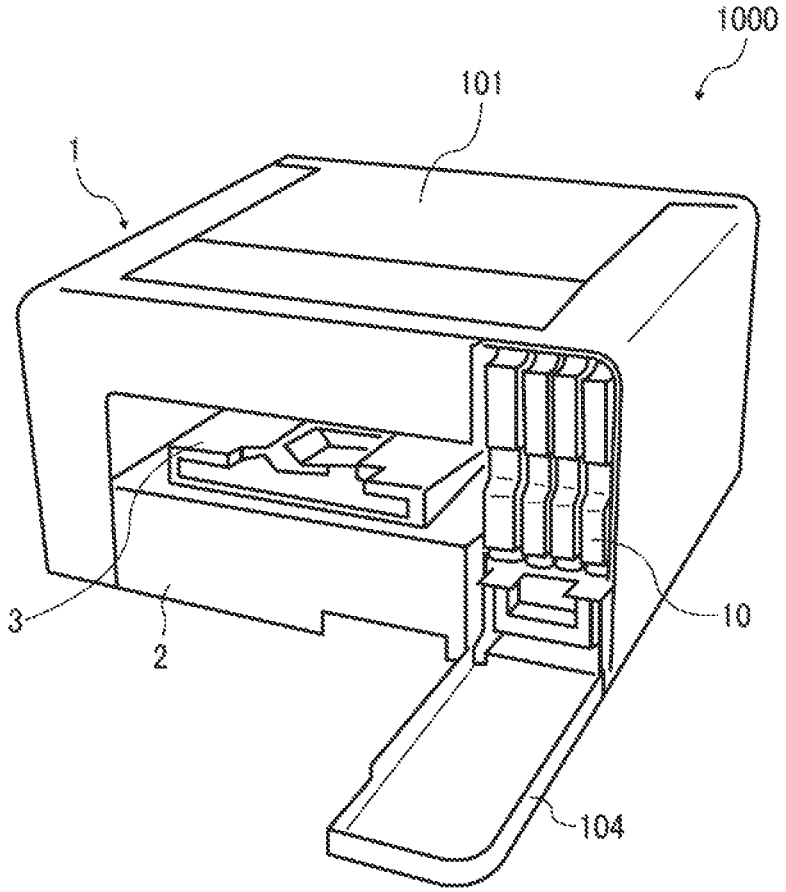
FIG. 1 is an outer perspective view of an example of an image forming apparatus according to an embodiment of this disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the embodiments are described with technical limitations with reference to the attached drawings, such description is not intended to limit the scope of the disclosure and all of the components or elements described in the embodiments of this disclosure are not necessarily indispensable.

Referring now to the drawings, embodiments of the present disclosure are described below. In the drawings for explaining the following embodiments, the same reference codes are allocated to elements (members or components) having the same function or shape and redundant descriptions thereof are omitted below.

Hereinafter, embodiments of the present disclosure are described with reference to the attached drawings. First, an example of an image forming apparatus according to an embodiment of this disclosure is described with reference to FIG. 1. FIG. 1 is an outer perspective view of an image forming apparatus according to an embodiment of this disclosure, in which a second waste liquid container is not mounted.

Hereinafter, embodiments of the present disclosure are described with reference to the attached drawings. First, an example of an image forming apparatus according to an embodiment of this disclosure is described with reference to FIG. 1. FIG. 1 is an outer perspective view of an image forming apparatus 1000 according to this embodiment.

In this embodiment, the image forming apparatus 1000 is a serial-type image forming apparatus. A cover 101 is disposed at an upper face side of an apparatus body 1 to be openable and closable. Opening the cover 101 allows access to a mechanical section in the apparatus body 1. At a front side of the apparatus body 1 are disposed a sheet feed tray 2 and a sheet ejection tray 3.

A cartridge cover 104, which is openable and closable, is disposed at one lateral side of a front face of the apparatus body 1. Opening the cartridge cover 104 allows mounting and unmounting of main tanks (also referred to as cartridges) serving as liquid cartridges relative to a cartridge holder 4 of the apparatus body 1.

Figure 2:
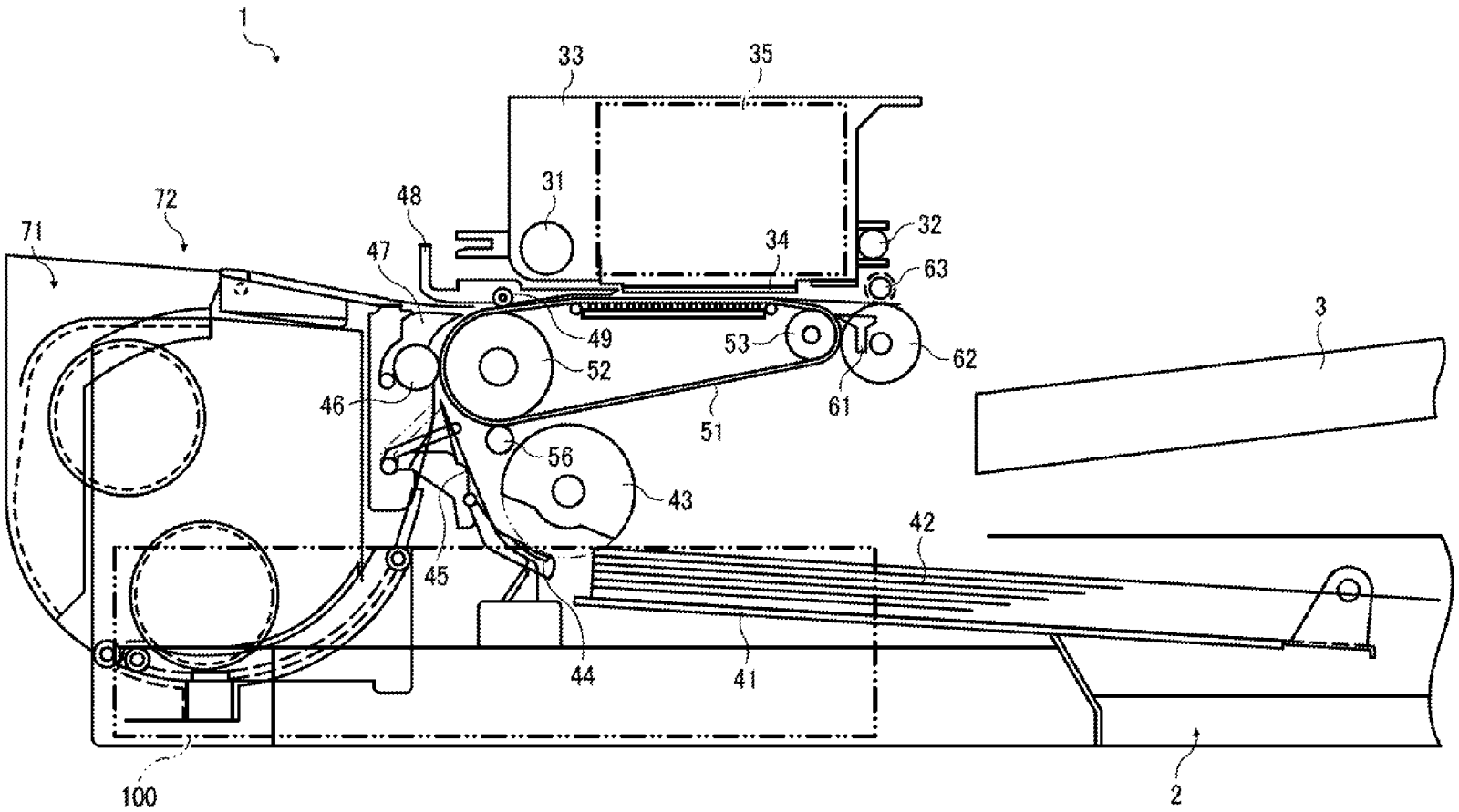
FIG. 2 is a side view of an example pf a mechanical section of the image forming apparatus of FIG. 1.
Figure 3:
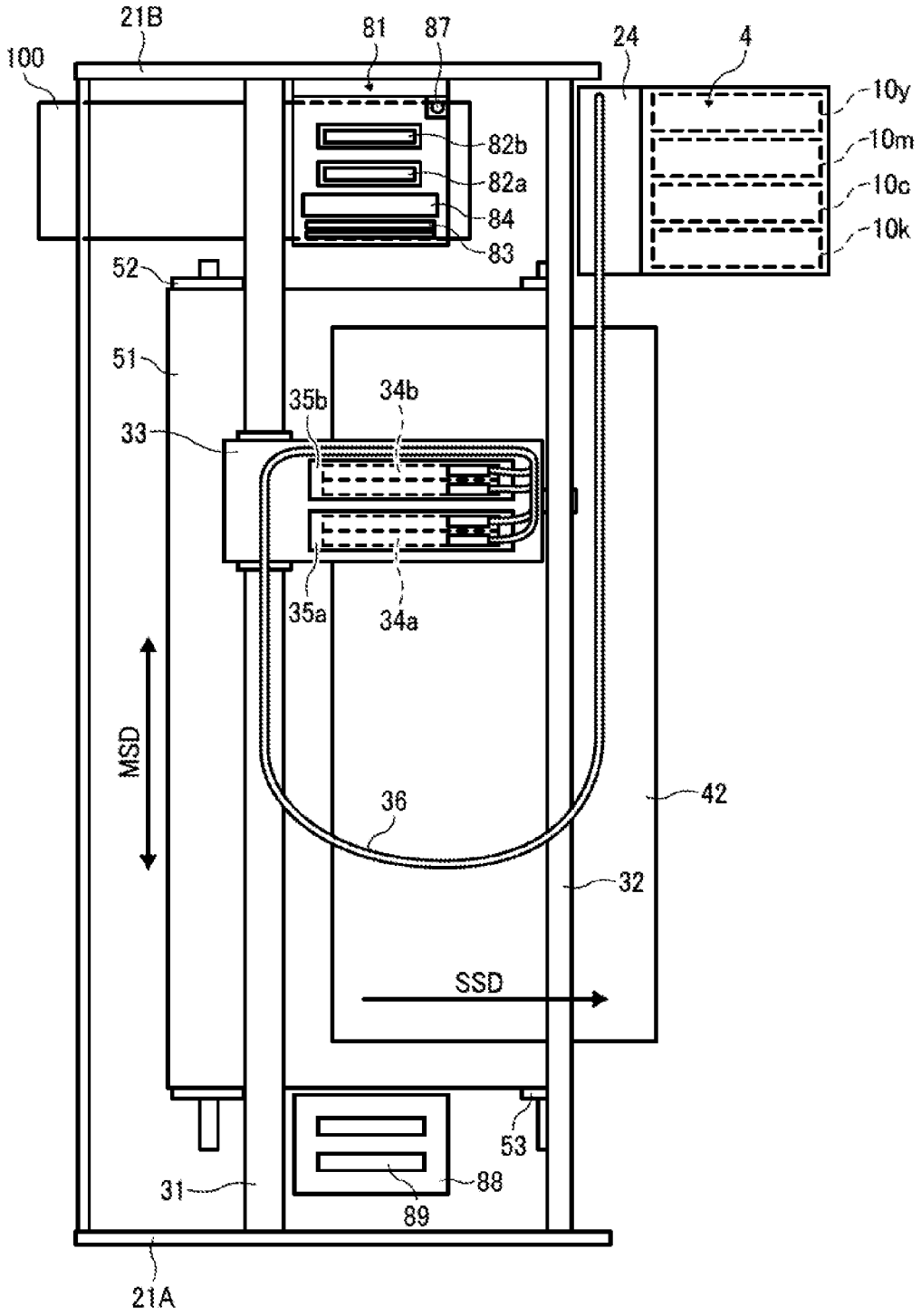
FIG. 3 is a partial plan view of the mechanical section of FIG. 2.

Next, an example of a print mechanical section of the image forming apparatus 1000 is described with reference to FIGS. 2 and 3. FIG. 2 is a side view of the print mechanical section. FIG. 3 is a plan view of a portion of the print mechanical section.

A main guide rod 31 and a sub-guide rod 32 serving as guides are laterally bridged between side plates 21A and 21B of the apparatus body 1 to support a carriage 33 slidably in a main scanning direction indicated by arrow MSD in FIG. 2. A main scanning motor 554 reciprocally moves the carriage 33 in the main scanning direction MSD in FIG. 2.

The carriage 33 mounts recording heads 34*a* and 34*b* serving as liquid ejection heads. The recording heads 34*a* and 34*b* are collectively referred to as "recording heads 34" unless distinguished (and other multiple components are referred in the same manner). The recording heads 34*a* and 34*b* discharge droplets of different colors, e.g., yellow (Y), cyan (C), magenta (M), and black (K).

In this embodiment, each of the recording heads 34 includes two nozzle rows. For example, one of the nozzle rows of the recording head 34*a* discharges droplets of black (K) and the other discharges droplets of cyan (C). In addition, one of the nozzle rows of the recording head 34*b* discharges droplets of magenta (M) and the other discharges droplets of yellow (Y).

In some embodiments, as the recording head 34, a recording head is used that has a nozzle face of one recording head (liquid discharge head) in which multiple rows, each including multiple nozzles, are arrayed to discharge droplets of respective colors.

The carriage 33 mounts head tanks 35*a* and 35*b* (collectively referred to as "head tanks 35" unless distinguished) to supply the respective color inks to the corresponding nozzle rows of the recording heads 34. The head tanks 35*a* and 35*b* are paired tanks corresponding to the nozzle rows of each of the recording heads 34*a* and 34*b*. That is, the carriage 33 includes multiple head tanks.

Main tanks 10*y*, 10*m*, 10*c*, and 10*k* (collectively referred to as main tanks 10 unless distinguished) corresponding to Y, M, C, and K colors, respectively, are detachably mounted to the cartridge holder 4. A liquid feed pump 241 supplies the respective color inks from the main tanks 10 to head tanks 35 via supply tubes (liquid supply passages) 36 for the respective colors.

The image forming apparatus 1000 further includes a sheet feeder to feed sheets 42 stacked on a sheet stacker 41 of the sheet feed tray 2. The sheet feeder further includes a sheet feed roller 43 and a separation pad 44. The sheet feed roller 43 separates and feeds the sheets 42 sheet by sheet from the sheet stacker 41. The separation pad 44 is disposed opposing the sheet feed roller 43.

To feed a sheet 42 fed from the sheet feeder to below the recording heads 34, the image forming apparatus 1000 includes a first guide 45 to guide the sheet 42, a counter roller 46, a conveyance guide 47, and a pressing member 48 including a leading-edge press roller 49. The image forming apparatus 1000 also includes a conveyance belt 51 serving as a conveyor to electrostatically attract the sheet 42 thereon and convey the sheet 42 to a position opposing the recording heads 34.

The conveyance belt 51 is an endless belt entrained around a conveyance roller 52 and a tension roller 53 to circulate in a belt conveyance direction (sub-scanning direction) indicated by arrow SSD in FIG. 2. The image forming apparatus 1000 also has a charging roller 56 serving as a charger to charge a surface of the conveyance belt 51. The charging roller 56 is disposed to contact a surface layer of the conveyance belt 51 and rotate with circulation of the conveyance belt 51. The conveyance roller 52 is rotated by a sub scanning motor via a timing belt, so that the conveyance belt 51 circulates in the belt conveyance direction.

The image forming apparatus 1000 further includes a sheet ejector to eject the sheet 42 on which an image has been formed by the recording heads 34. The sheet ejector includes a separation claw 61 to separate the sheet 42 from the conveyance belt 51, a first ejection roller 62, a spur roller 63 serving as a second ejection roller, and the sheet ejection tray 3 disposed at a position lower than the first ejection roller 62.

A duplex unit 71 is detachably mounted on a rear face portion of the apparatus body 1. When the conveyance belt 51 rotates in reverse to return the sheet 42, the duplex unit 71 receives the sheet 42. Then the duplex unit 71 reverses and feeds the sheet 42 to a nipping portion between the counter roller 46 and the conveyance belt 51. A bypass tray 72 is formed at an upper face of the duplex unit 71.

As illustrated in FIG. 2, a maintenance assembly (maintenance and recovery assembly) 81 is disposed in a non-printing area (non-recording area) at one end in the main scanning direction MSD of the carriage 33. The maintenance assembly 81 maintains and recovers nozzle conditions of the recording heads 34.

The maintenance assembly 81 includes, for example, a suction cap 82*a*, a moisture-retention cap 82*b* (the suction cap 82*a* and the moisture-retention cap 82*b* are also referred to as caps 82 unless distinguished), and a wiper (wiper blade) 83. The suction cap 82*a* caps the nozzle face of any one of the recording heads 34 to suck ink from the nozzles. The suction cap 82*a* also caps the nozzle face of any one of the recording heads 34 for moisture retention. The moisture-retention cap 82*b* caps the nozzle face of any one of the recording heads 34 for moisture retention. The wiper 83 wipes the nozzle face of the recording head 34.

The maintenance assembly 81 further includes a first dummy-discharge receptacle 84 and a carriage lock 87. The first dummy-discharge receptacle 84 receives droplets discharged by dummy discharge in which droplets not contributing to image recording are discharged to remove thickened recording liquid. The carriage lock 87 locks the carriage 33. Below the maintenance assembly 81, a waste liquid tank 100 is removably mounted to the apparatus body 1 to store waste ink or liquid discharged by the maintenance and recovery operation.

As illustrated in FIG. 2, a second dummy-discharge receptacle 88 is disposed at a non-printing area on the opposite end in the main scanning direction MSD of the carriage 33. The second dummy-discharge receptacle 88 receives droplets discharged, e.g., during recording (image forming) operation by dummy discharge in which droplets not contributing to image recording are discharged to remove viscous recording liquid. The second dummy-discharge receptacle 88 has openings 89 arranged in parallel to the nozzle rows of the recording heads 34.

In the image forming apparatus 1000 having the above-described configuration, the sheets 42 are separated sheet by sheet from the sheet feed tray 2, fed in a substantially vertically upward direction, guided along the first guide 45, and conveyed while being sandwiched between the conveyance belt 51 and the counter roller 46. Further, a leading edge of the sheet 42 is guided by the conveyance guide 47 and is pressed against the conveyance belt 51 by the leading-edge press roller 49 to turn a conveyance direction of the sheet 42 by approximately 90°.

At this time, the conveyance belt 51 is charged in alternating charge voltage pattern with the charging roller 56. When the sheet 42 is fed onto the conveyance belt 51 charged, the sheet 42 is attracted onto the conveyance belt 51 and conveyed in the sub-scanning direction SSD by circulation of the conveyance belt 51.

By driving the recording heads 34 in accordance with image signals while moving the carriage 33, ink droplets are discharged onto the sheet 42, which is stopped below the recording heads 34, to form one line of a desired image. Then, the sheet 42 is fed by a certain distance to prepare for the next operation to record another line of the image. Receiving a recording end signal or a signal indicating that the rear end of the sheet 42 has arrived at the recording area, the recording operation finishes and the sheet 42 is output to the sheet ejection tray 3.

Figure 4:
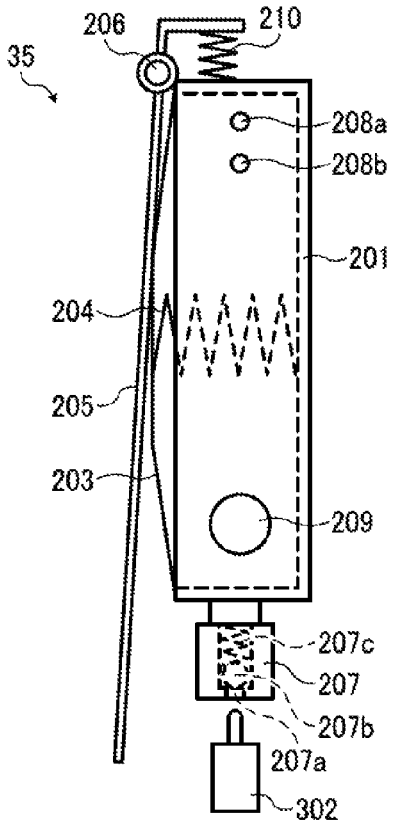
FIG. 4 is a plan view of an example of a head tank of the image forming apparatus.
Figure 5:
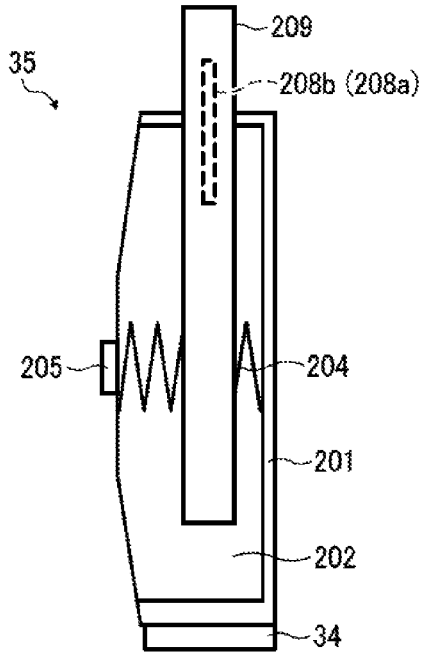
FIG. 5 is a front view of the head tank of FIG. 4.

Next, an example of the head tank 35 is described with reference to FIGS. 4 and 5. FIG. 4 is a schematic upper plan view of the head tank. FIG. 5 is a schematic front view of the head tank of FIG. 4.

The head tank 35 has a tank case 201 including a liquid containing part 202 to contain ink and having an opening at one lateral side. In this embodiment, as described above, a pair of two head tanks 35 are disposed to supply different color liquids to the respective nozzle rows of each of the recording heads 34.

The opening of the tank case 201 is sealed with a film 203 serving as a flexible member to form the liquid containing part 202. The film 203 is constantly urged outward by a restoring force of a spring 204 serving as an elastic member disposed in the tank case 201.

Thus, since the restoring force of the spring 204 acts on the film 203 of the tank case 201, a decrease in the remaining amount of liquid in the liquid containing part 202 of the tank case 201 creates a negative pressure.

At the exterior of the tank case 201 is disposed a displacement member (hereinafter, may also be referred to as simply "feeler") 205 formed with a feeler having one end swingably supported by a shaft 206.

The displacement member 205 is urged toward the tank case 201 by a spring 210 and pressed against the film 203. Accordingly, the displacement member 205 displaces with movement of the film 203.

The displacement member 205 is detected with, e.g., a body sensor 301 serving as a body-side detector disposed at the apparatus body 1, thus allowing detection of the remaining amount of liquid or negative pressure in the head tank 35.

A supply port portion 209 is disposed at an upper portion of the tank case 201 and connected to a supply tube 36 to supply liquid from the main tank 10. At one lateral side of the tank case 201, an air releaser 207 serving as an air releaser is disposed to release the interior of the head tank 35 to the atmosphere.

The air releaser 207 includes, for example, an air release passage 207*a* communicating with the interior of the head tank 35, a valve body 207*b* to open and close the air release passage 207*a*, and a spring 207*c* to urge the valve body 207*b* into a closed state. An air release solenoid 302 is disposed at the apparatus body 1, and the valve body 207*b* is pushed by the air release solenoid 302 to open the air release passage 207*a*, thus causing the interior of the head tank 35 to be opened to the atmosphere (in other words, causing the interior of the head tank 35 to communicate with the atmosphere).

The head tank 35 are provided with electrode pins 208*a* and 208*b* (also referred to as electrode pins 208) serving as a liquid level detector to detect a liquid level of liquid in the head tank 35. Since liquid has electric conductivity, when the liquid level reaches the electrode pins 208*a* and 208*b*, electric current flows between the electrode pins 208*a* and 208*b* and the resistance values of the electrode pins 208*a* and 208*b* change. Such a configuration can detect that the liquid level has decreased to a threshold level or lower.

Figure 6:
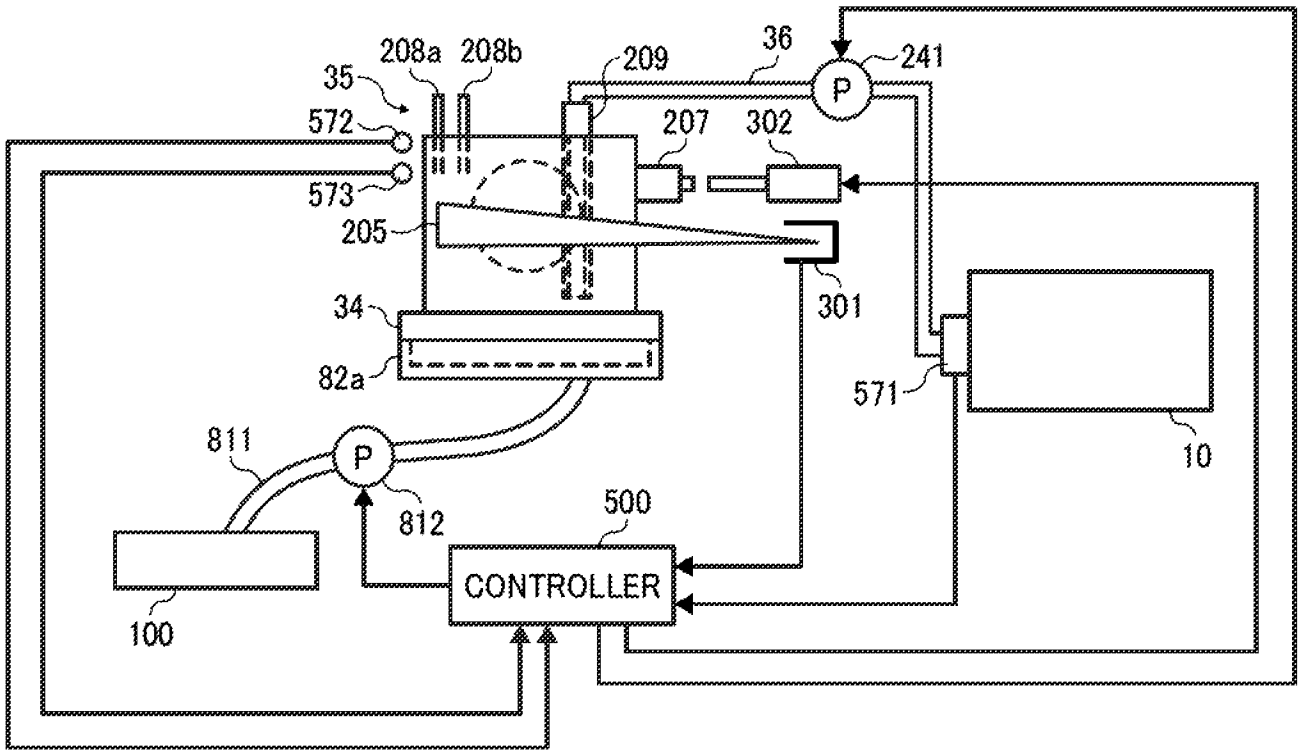
FIG. 6 is an illustration of a liquid supply-and-discharge system of the image forming apparatus.

Next, a liquid supply-and-discharge system of the image forming apparatus according to this embodiment is described with reference to FIG. 6. FIG. 6 is a schematic view of the liquid supply-and-discharge system in this embodiment.

A liquid feed pump 241 serving as a liquid feeder supplies liquid from the main tank 10 to the head tank 35 via the supply tube 36.

The liquid feed pump 241 is a reversible pump (reversible liquid feeder), e.g., a tube pump, capable of performing normal feed operation to supply liquid from the main tank 10 to the head tank 35 and reverse feed operation to return liquid from the head tank 35 to the main tank 10.

The maintenance assembly 81 includes the suction cap 82*a* to cap a nozzle face of any one of the recording heads 34 and a suction pump 812 connected to the suction cap 82*a*. The suction pump 812 is driven with the nozzle face capped with the suction cap 82*a* to suck liquid from the nozzles via a suction tube 811, thus allowing liquid to be sucked from the head tank 35. Waste liquid sucked from the head tank 35 is discharged to a waste liquid tank 100.

The air release solenoid 302 serving as a pressing member to open and close the air releaser 207 of the head tank 35 is disposed at the apparatus body 1. By activating the air release solenoid 302, the air releaser 207 can be opened.

The liquid supply-and-discharge system also includes a pressure detector 571 to detect that the pressure of the liquid supply passage (supply tube 36) between the main tank 10 and the head tanks 35 is a threshold value or lower. In this embodiment, the pressure detector 571 is disposed between the main tank 10 and the liquid feed pump 241.

The liquid supply-and-discharge system further includes a temperature sensor 572 serving as a temperature detector to detect a temperature near the head tank 35 and a humidity sensor 573 to detect humidity near the head tank 35.

A controller 500 performs drive control of the liquid feed pump 241, the air release solenoid 302, and the suction pump 812 and control of post-end printing.

Figure 7:
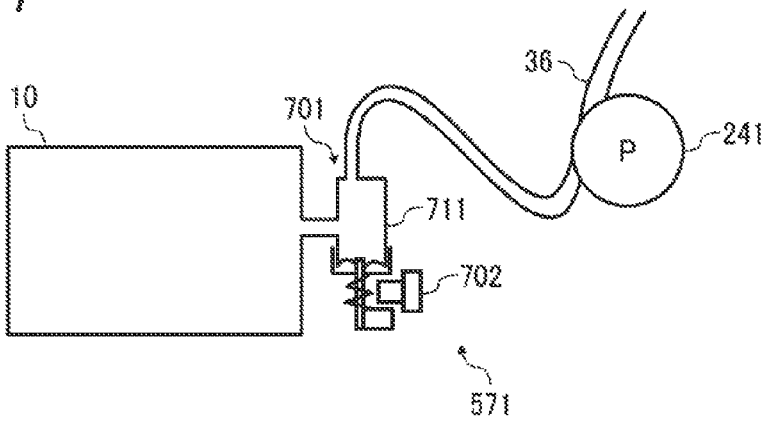
FIG. 7 is a schematic view of an example of a pressure detector and a nearby portion.
Figure 8:
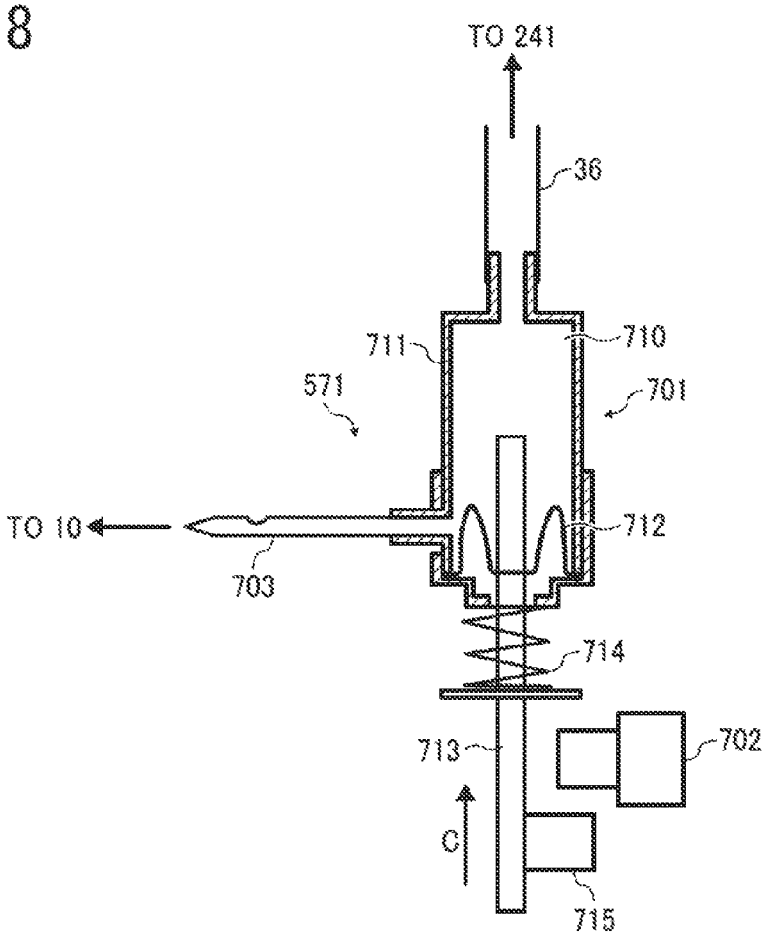
FIG. 8 is an illustration of the pressure detector of FIG. 7.

Next, an example of the pressure detector is described with reference to FIGS. 7 and 8. FIG. 7 is a schematic view of the pressure detector and a nearby portion. FIG. 8 is an illustration of the pressure detector.

A pressure detector 571 in this example includes a pressure detection part 701 intervening a liquid supply passage (supply tube 36) and a sensor 702 to detect that an internal pressure of the liquid supply passage detected with pressure detection part 701 is a predetermined pressure or lower.

The pressure detection part 701 is communicated with a main tank 10 via a hollow needle 703 and includes a channel formation member 711 forming a channel 710 communicated with the liquid feed pump 241 via the supply tube 36. A portion of the channel 710 is formed of a deformable elastic member 712. The elastic member 712 is connected to a rod 713, and a spring 714 urges the rod 713 outward of the channel formation member 711.

The sensor 702 is formed of, e.g., a transmissive photosensor to detect a detection piece (feeler) 715 mounted on the rod 713. When the pressure of the channel 710 of the channel formation member 711 decreases and the rod 713 is drawn into a predetermined position in the channel formation member 711, the sensor 702 detects the detection piece 715.

Figure 9:
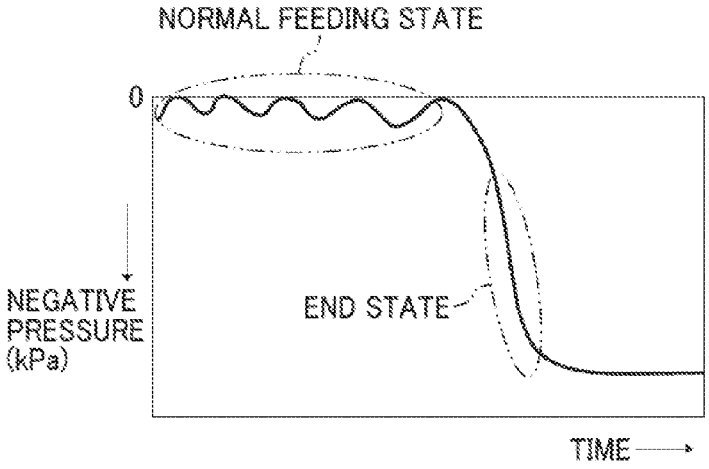
FIG. 9 is an illustration of a change in pressure between a main tank and a liquid feed pump.

Operation of the pressure detector 571 thus configured is described with reference to FIGS. 9 and 10. FIG. 9 is an illustration of a change in pressure between a main tank and the liquid feed pump. FIGS. 10A and 10B are illustrations of operation of the pressure detector.

Figure 10A:
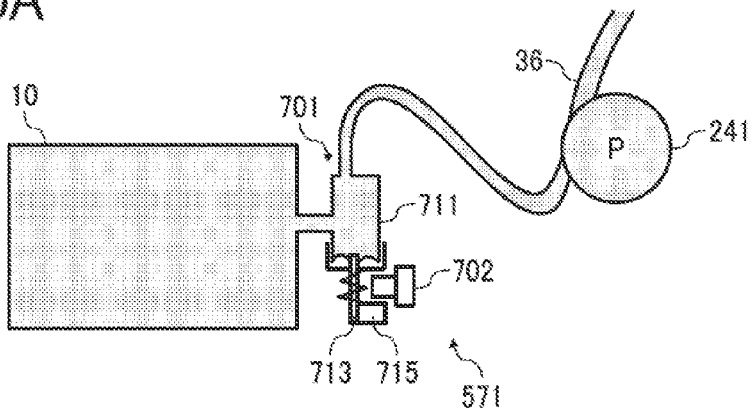
FIGS. 10A and 10B are illustrations of operation of the pressure detector.

In normal liquid feeding in which a certain amount of liquid remains in a main tank 10 as illustrated in FIG. 10A (the main tank 10 is not in the end state), as illustrated in FIG. 9, a channel between the main tank 10 and the liquid feed pump 241 only pulsates even when liquid is supplied with the liquid feed pump 241.

Figure 10B:
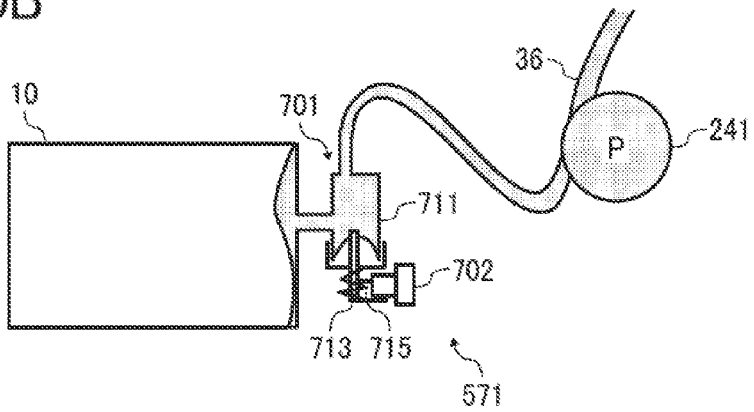

By contrast, when liquid is supplied with the liquid feed pump 241 in the end state of the main tank 10 as illustrated in FIG. 10B, as illustrated in FIG. 9, the pressure in the channel between the main tank 10 and the liquid feed pump 241 rapidly falls (the negative pressure in the channel rapidly increases).

Accordingly, when the main tank 10 is not in the end state, as illustrated in FIG. 10A, the detection piece 715 of the rod 713 is placed at a position not opposing the sensor 702.

By contrast, when the main tank 10 turns into in the end state and the pressure in the channel between the main tank 10 and the liquid feed pump 241 decreases, the elastic member 712 is introduced into the channel 710 and the rod 713 displaces in a direction indicated by arrow C. As a result, the detection piece 715 is placed as a position opposing the sensor 702.

Accordingly, the sensor 702 detects the detection piece 715, thus allowing detection of the end state of the main tank 10.

Figure 11:
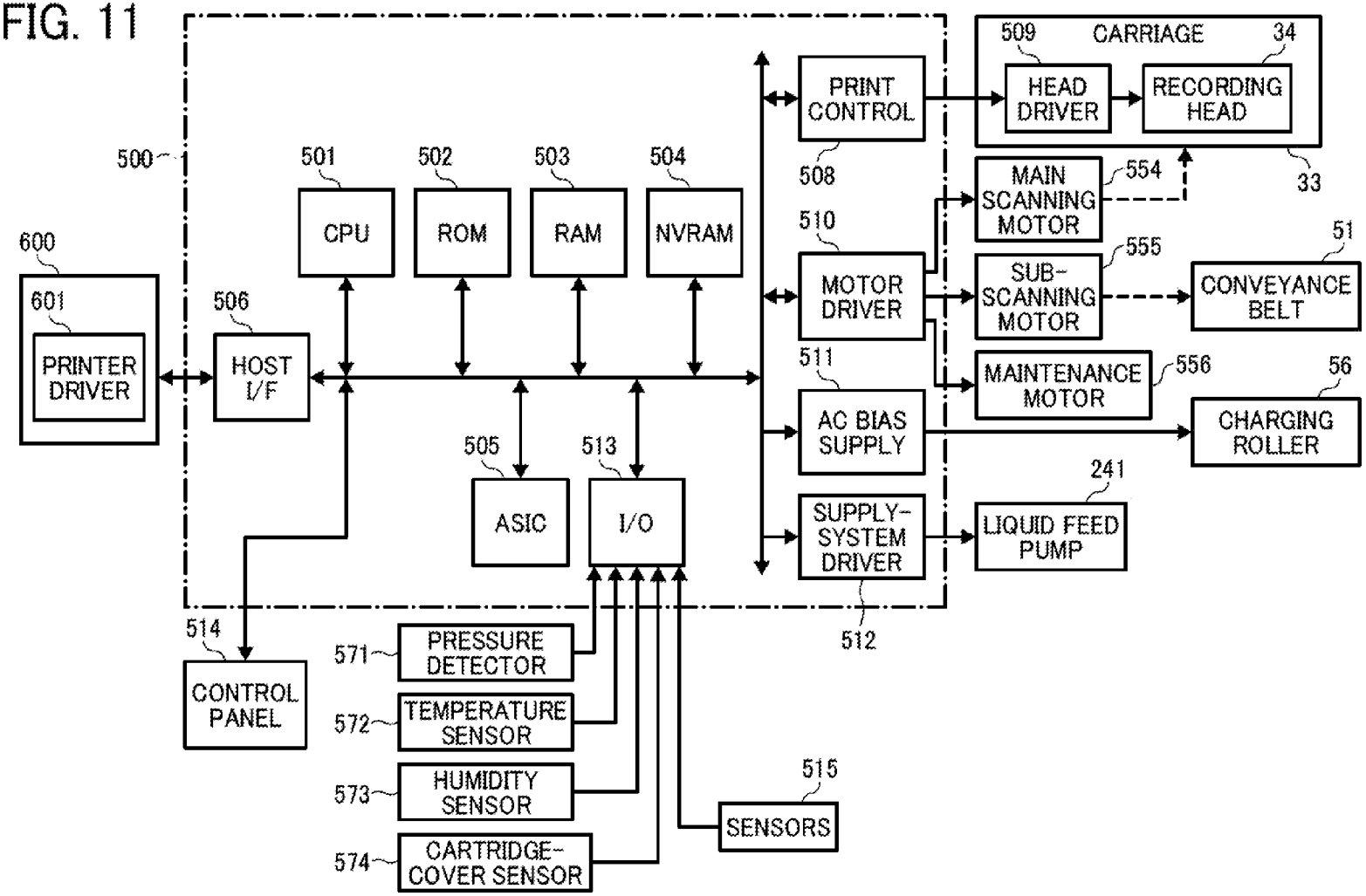
FIG. 11 is a block diagram of a controller according to an embodiment of this disclosure.

Next, an outline of a controller of the image forming apparatus 1000 is described with reference to FIG. 11. FIG. 7 is a block diagram of the controller 500 of the image forming apparatus.

The controller 500 includes a central processing unit (CPU) 501, a read-only memory (ROM) 502, a random access memory (RAM) 503, a non-volatile random access memory (NVRAM) 504, and an application-specific integrated circuit (ASIC) 505. The CPU 501 manages the control of the entire image forming apparatus 1000. The ROM 502 stores fixed data, such as various programs including programs executed by the CPU 501, and the RAM 503 temporarily stores image data and other data.

The NVRAM 504 is a rewritable memory capable of retaining data even when the apparatus is powered off The ASIC 505 processes various signals on image data, performs sorting or other image processing, and processes input and output signals to control the entire apparatus.

The controller 500 also includes a print control 508 and a head driver (driver integrated circuit) 509. The print control 508 includes a data transmitter and a driving signal generator to drive and control the recording heads 34. The head driver 509 drives the recording heads 34 mounted on the carriage 33.

The controller 500 further includes a main scanning motor 554, a sub-scanning motor 555, and a motor driver 510. The main scanning motor 554 moves the carriage 33 for scanning, and the sub-scanning motor 555 circulates the conveyance belt 51. The motor driver 510 drives a maintenance motor 556 of the maintenance assembly 81 to move the caps 82 and the wiper 83 of the maintenance assembly 81 or suck ink with the suction pump 812.

The controller 500 further includes an alternating-current (AC) bias supply 511 and a supply-system driver 512. The AC bias supply 511 supplies AC bias to the charging roller 56. The supply-system driver 512 drives liquid feed pumps 241 of the supply pump unit 24.

The controller 500 is connected to a control panel 514 serving as an input unit to input and a notifier to display information necessary to the image forming apparatus 1000.

The controller 500 includes a host interface (I/F) 506 for transmitting and receiving data and signals to and from a printer driver 601 of a host 600, such as an information processing device (e.g., personal computer), an image reading device, or an image pick-up device, via a cable or network.

The CPU 501 of the controller 500 reads and analyzes print data stored in a reception buffer of the I/F 506, performs desired image processing, data sorting, or other processing with the ASIC 505, and transfers image data from the print control 508 to the head driver 509.

The print control 508 transfers the above-described image data as serial data and outputs to the head driver 509, for example, transfer clock signals, latch signals, and control signals required for the transfer of image data and determination of the transfer.

In addition, the print control 508 includes the driving signal generator including, e.g., a digital/analog (D/A) converter (to perform digital/analog conversion on pattern data of driving pulses stored on the ROM 502), a voltage amplifier, and a current amplifier. The print control 508 outputs a driving signal containing one or more driving pulses from the driving signal generator to the head driver 509.

In accordance with serially-inputted image data corresponding to one line recorded by the recording heads 34, the head driver 509 selects driving pulses of a driving waveform transmitted from the print control 508 and applies the selected driving pulses to the pressure generator to drive the recording heads 34. Thus, the recording heads 34 are driven. At this time, by selecting a part or all of the driving pulses forming the driving waveform or a part or all of waveform elements forming a driving pulse, the recording heads 34 can selectively discharge dots of different sizes, e.g., large droplets, medium droplets, and small droplets.

The I/O unit 513 obtains information from the pressure detector 571, a temperature sensor 572, a humidity sensor 573, a cartridge-cover sensor 574 to detect opening of the cartridge cover 104, and various types of sensors 515 mounted in the image forming apparatus 1000. The I/O unit 513 also extracts information necessary for controlling the image forming apparatus 1000 and uses such information to perform various controls.

Figure 12:
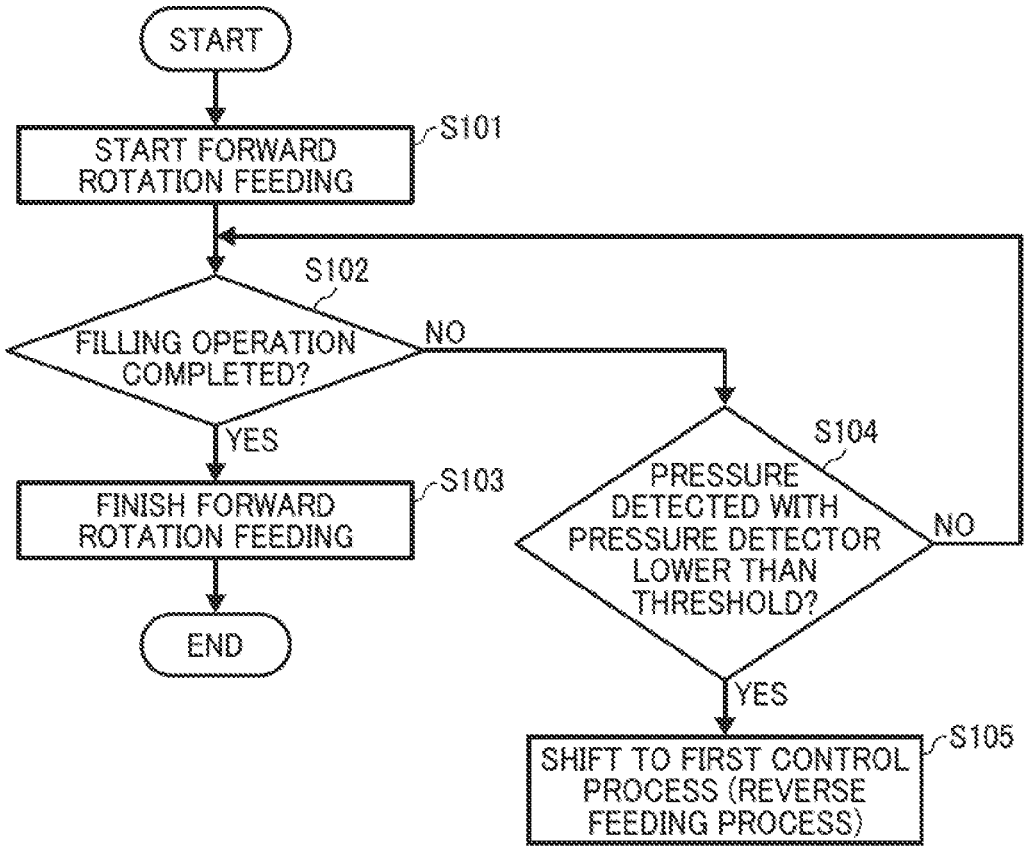
FIG. 12 is a flow chart of an example of a process flow of filling liquid from a main tank to a head tank executed by the controller.

Next, a process flow of filling liquid from a main tank to a head tank executed by the controller according to an embodiment of this disclosure is described with reference to FIG. 12. FIG. 12 is a flow chart of an example of a process flow of filling liquid from a main tank to a head tank executed by the controller.

The liquid filling process is started when liquid filling from a main tank 10 to a head tank 35 is needed.

Here, the phrase "when liquid filling from a main tank 10 to a head tank 35 is needed" means, for example, when a displacement member 205 displaces in a direction to decrease the remaining amount of liquid in the head tank 35 and passes through a predetermined filling start position, when the consumption amount of liquid in the head tank 35 is a predetermined threshold amount or greater, and when the air releaser 207 is opened and liquid is supplied until electrode pins 208 detect a liquid level (liquid surface).

With the start of the filling process, at S101 the liquid feed pump 241 rotates forward and starts feeding (forward rotation feeding) of liquid to the head tank 35.

At S102, the controller 500 determines whether the filling operation is completed. The completion of the filling operation can be determined based on, for example, 1) whether the displacement member 205 has displaced in a direction to increase the remaining amount of liquid in the head tank 35 and has arrived at a predetermined filling full position, 2) whether the drive time of the liquid feed pump 241 has reached a threshold time, 3) whether the number of rotation of the liquid feed pump 241 has reached a threshold number of rotation, and 4) whether the liquid surface is detected with the electrode pins 208.

When the controller 500 determines that the filling operation is completed (YES at S102), at S103 the controller 500 finishes the forward rotation operation of the liquid feed pump 241 and finishes the forward rotation feeding.

By contrast, when the controller 500 determines that the filling operation is not completed (NO at S102), at S104 the controller 500 determines whether the pressure in the liquid supply passage is a threshold value or lower, in other words, whether the main tank 10 is in an end state, based on a detection result of the pressure detector 571.

When the controller 500 determines that the pressure in the liquid supply passage is higher than a threshold value (NO at S104), the controller 500 continues the filling operation (and the process goes back to S102).

By contrast, when the controller 500 determines that the pressure in the liquid supply passage is the threshold value or lower, based on the detection result of the pressure detector 571 (YES at S104), at S105 the process shifts to a reverse feeding process (first control process) to return liquid from the head tank 35 to the main tank 10.

Figure 13:
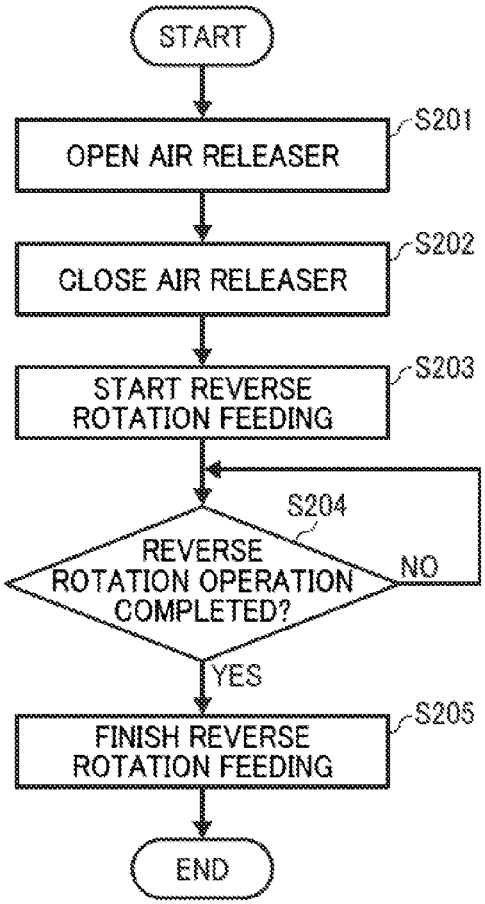
FIG. 13 is a flow chart of a first example of a reverse feeding process (first control process) of FIG. 12.

Next, a first example of the reverse feeding process (first control process) is described with reference to FIG. 13. FIG. 13 is a flow chart of the first example of the reverse feeding process (first control process).

When the controller 500 detects with the pressure detector 571 that the pressure in the liquid supply passage is the threshold value or lower (the main tank 10 is in the end state) (YES at S104), liquid filling into the head tank 35 is not performed. Accordingly, it is assumed that the remaining amount of liquid in the head tank 35 is relatively small (the negative pressure in the head tank 35 is relatively large). In addition, since liquid is not fed from the main tank 10, it is assumed that the supply tube 36 of the liquid feed pump 241 and the negative pressure in the pressure detector 571 are relatively large.

At this time, if replacement of the main tank 10 is performed without releasing the negative pressure, air may be introduced from an upstream side (main tank side) of the liquid supply passage by action of the negative pressure in the liquid supply passage. If such air is introduced into the liquid supply passage, the following failure may arise.

For example, when liquid is fed into the head tank 35, air bubbles might hamper accurate detection of the liquid surface with the electrode pins 208. When barmy liquid leaks from the air releaser 207 into the inside of the image forming apparatus and adheres to an electric circuit, an electric board might be damaged and the inside of the image forming apparatus might be contaminated. Such barmy liquid might also act as a pressure damper and cause ejection failure.

Hence, when the reverse feeding process starts, at S201 the air releaser 207 of the head tank 35 is opened. After the inside of the head tank 35 is opened to an ambient atmosphere to release the negative pressure, at S202 the air releaser 207 is closed.

At S203, the liquid feed pump 241 is driven for reverse rotation to feed a threshold amount (first threshold amount) of liquid in reverse from the head tank 35 to the main tank 10 to release the negative pressure in the liquid feed pump 241 and the pressure detector 571.

At S204, the controller 500 determines whether the reverse rotation operation is completed.

Here, the completion of the reverse rotation operation can be determined based on, for example, 1) whether the reverse rotation feeding has been performed for a threshold time period and 2) whether the liquid feed pump 241 has been rotated a threshold number of times.

When the reverse rotation operation is completed (YES at S204), at S205 the controller 500 stops driving of the reverse rotation of the liquid feed pump 241 to finish the reverse rotation feeding (reverse feeding). Thus, the reverse feeding process ends.

Figure 14:
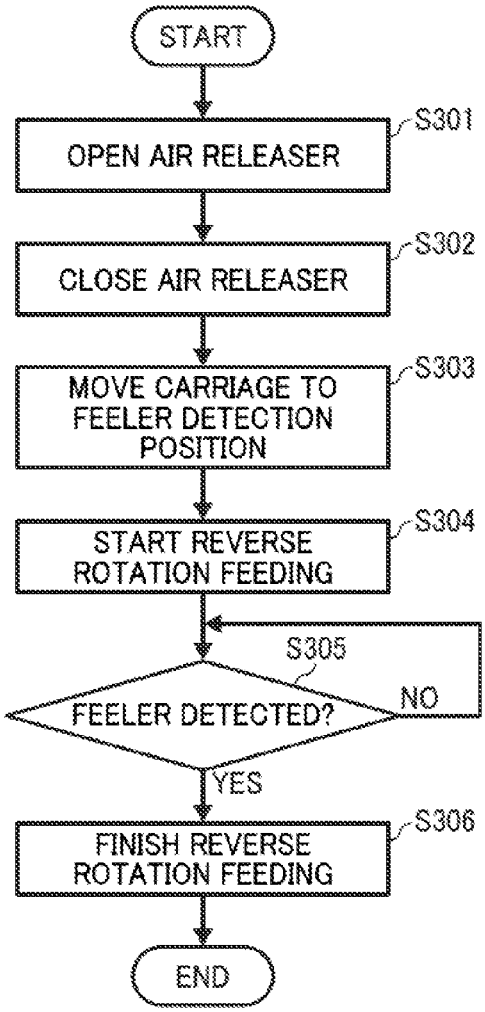
FIG. 14 is a flow chart of a second example of the reverse feeding process (first control process)

Next, a second example of the reverse feeding process (first control process) is described with reference to FIG. 14. FIG. 14 is a flow chart of the second example of the reverse feeding process (first control process).

Like the above-described first example, when the reverse feeding process starts, at S301 the air releaser 207 of the head tank 35 is opened. After the inside of the head tank 35 is opened to an ambient atmosphere to release the negative pressure, at S302 the air releaser 207 is closed.

At S303, the carriage 33 is moved to a position at which the displacement member (feeler) 205 of the head tank 35 is detectable with the apparatus sensor 301.

At S04, the liquid feed pump 241 is driven for reverse rotation to feed a threshold amount (first threshold amount) of liquid in reverse from the head tank 35 to the main tank 10 to release the negative pressure in the liquid feed pump 241 and the pressure detector 571.

At S305, the controller 500 determines whether the displacement member 205 of the head tank 35 is detected with the apparatus sensor 301.

When the displacement member 205 of the head tank 35 is detected with the apparatus sensor 301 (YES at S305), at S306 the controller 500 stops driving of the reverse rotation of the liquid feed pump 241 to finish the reverse rotation feeding. Thus, the reverse feeding process ends.

Note that, since the reverse rotation feeding operation is performed after the air releaser 207 is opened and closed, the reverse rotation feeding operation also serves as a negative pressure forming operation of the head tank 35. Accordingly, the controller 500 can shift to a subsequent post-end printing control process (second control process) without performing an additional operation.

Figure 15:
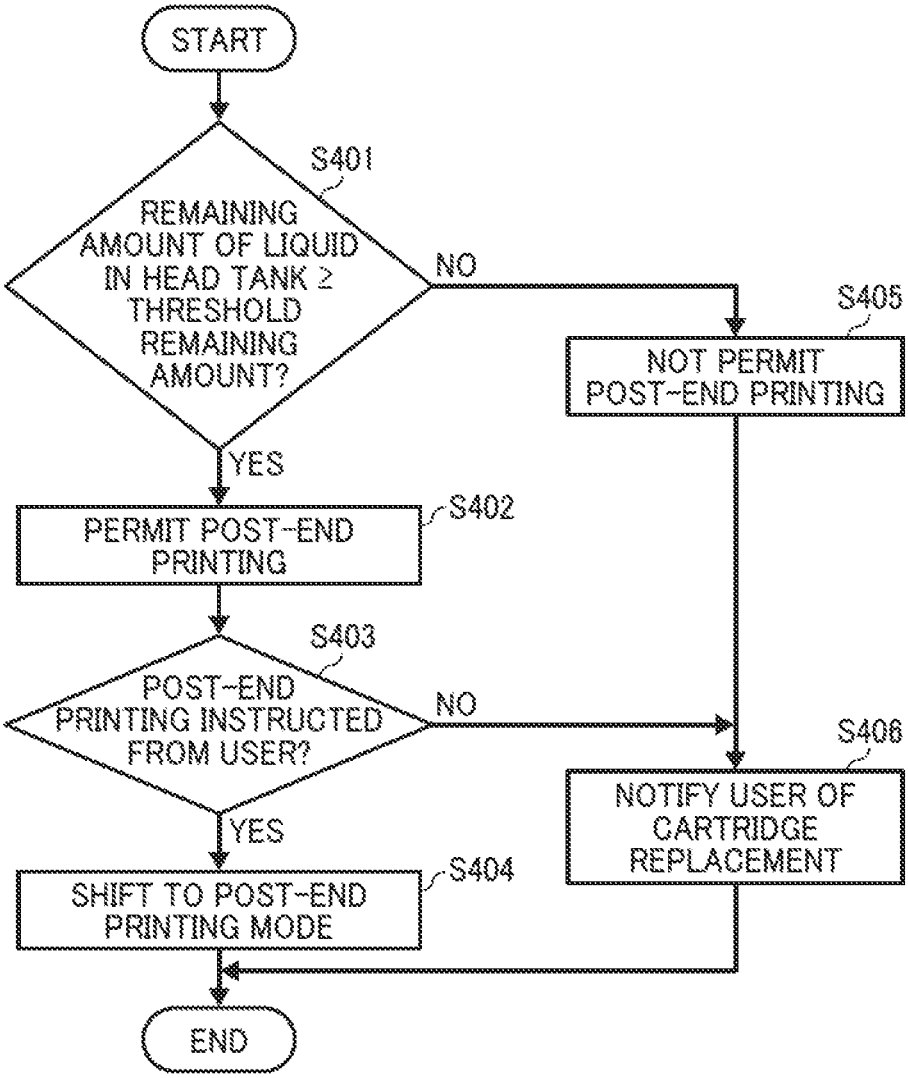
FIG. 15 is a flow chart of an example pf a post-end printing process (second control process) executed by the controller.

Next, an example pf the post-end printing process (second control process) executed by the controller is described with reference to FIG. 15. FIG. 15 is a flow chart of an example pf the post-end printing process.

The post-end printing is a printing method in which, for example, when a color ink other than black ink is in an end state, the controller 500 permits only monochromatic printing. In such a case, for a recording head for a non-black color ink, only dummy discharge and other maintenance operation to maintain normal performance of nozzles is permitted and printing is not permitted for the recording head for the non-black color ink.

When black ink is in the end state, monochromatic printing in composite black using three types of non-black color inks can be permitted.

Such a configuration allows monochromatic printing even when a new main tank (cartridge) is not readily available for replacement.

In other words, the post-end printing is a printing operation accompanying consumption of a residual liquid of a head tank corresponding to a main tank determined to be in the end state. Note that the term "corresponding" means that the head tank is a head tank to be fed from the main tank in the end state. However, it does not necessary means that liquid is fed from the main tank to the head tank in the post-end printing.

For the post-end printing in this embodiment, residual liquid in the head tank corresponding to the main tank determined to be in the end state is not used for image formation and is used only for operation to maintain nozzle conditions. Image formation is performed using liquid of a head tank supplied from a main tank not determined to be in the end state.

In the post-end printing process, after the reverse feeding process is performed, at S401 the controller 500 determines whether the remaining amount of liquid in the head tank 35 is a predetermined threshold remaining amount (second threshold amount).

When the remaining amount of liquid is the threshold remaining amount or greater (YES at S401), at S402 the controller 500 permits post-end printing.

At S403 the controller 500 determines whether post-end printing is instructed from a user. When post-end printing is instructed (YES at S403), at S404 the controller 500 shifts to a post-end printing mode. When post-end printing is not instructed (NO at S403), at S406 the controller 500 prompts the user to replace cartridges and finishes the post-end printing process.

By contrast, when the remaining amount of liquid is smaller than the threshold remaining amount (NO at S401), at S405 the controller 500 does not permit post-end printing.

At S406 the controller 500 prompts the user to replace cartridges (main tanks) and finishes the post-end printing process.

As described above, the controller 500 permits only when the remaining amount of liquid in a head tank is a threshold remaining amount or greater, the controller 500 permits post-end printing. Such a configuration prevents post-end printing from being permitted, executed, and stopped uncompleted even when the remaining amount of liquid in the head tank is an amount at which post-end printing is not available.

In other words, for example, when a non-black color ink is in the end state and post-end printing only permitting monochromatic printing is performed, the non-black color ink is in the end state and is not used for printing in a sense of discharging to a sheet. However, if the non-black color ink is not discharged at all, nozzle failure may arise in the nozzles for the non-black color ink. Hence, in this embodiment, only a regular operation to maintain the nozzle conditions. e.g., dummy discharge is permitted. The regular dummy discharge includes, for example, a pre-printing dummy discharge to discharge liquid before printing, an in-printing dummy discharge to discharge liquid at regular intervals during printing, and a post-leaving dummy discharge to discharge liquid after liquid is not discharged from a head tank for a long time period.

Here, if monochromatic printing causes the remaining amount of a non-black color ink to be smaller than the second threshold amount required for dummy discharge, sufficient dummy discharge would not be performed even when the process shifts to post-end printing. Hence, in this embodiment, when the remaining amount of a non-black color ink is not greater than the second threshold amount, the controller 500 does not permit post-end printing in the end state of the non-black color ink.

Figure 16A:
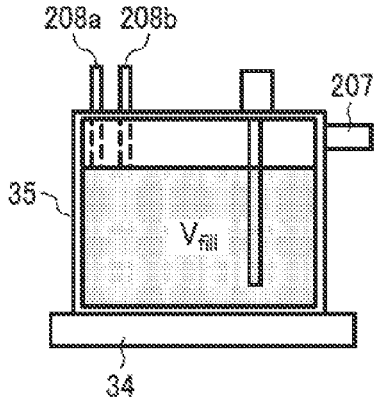
FIGS. 16A, 16B, and 16C are illustrations of a determination process of a remaining amount of liquid in a post-end printing control process.

Next, a determination process of the remaining amount of liquid in the above-described post-end printing control process is described with reference to FIGS. 16A, 16B, and 16C.

Figure 16B:
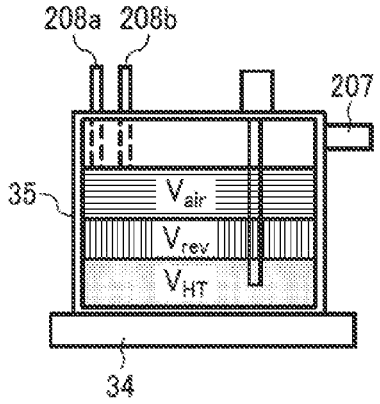

A remaining amount of liquid $V_{HT}$ remaining in the head tank 35 illustrated in FIG. 16B is obtained by subtracting an amount of air $V_{air}$ introduced by opening and closing of the air releaser 207 in the reverse feeding process and an amount of liquid $V_{rev}$ fed by the reverse rotation feeding from a volume of liquid $V_{fill}$ fully filled in the head tank 35. The remaining amount of liquid $V_{HT}$ remaining in the head tank 35 is expressed by the following Formula 1:

$$V_{HT}=V_{fill}-V_{air}-V_{rev} \quad (1).$$

Figure 16C:
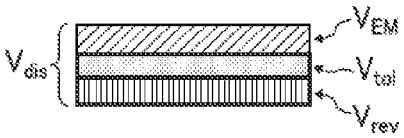

Here, the remaining amount of liquid $V_{HT}$ is a threshold remaining amount $V_{EM}$ or greater as illustrated in FIG. 16C, the controller 500 permits post-end printing. The threshold remaining amount $V_{EM}$ is obtained by subtracting an amount of liquid $V_{rev}$ fed by the reverse rotation feeding and a tolerance amount of liquid $V_{tol}$ from an amount of liquid $V_{dis}$ dischargeable from an air release state. The threshold remaining amount $V_{EM}$ is expressed by the following Formula 2:

$$V_{EM}=V_{dis}-V_{air}-V_{tol} \quad (2).$$

Examples of the tolerance amount $V_{tol}$ are as follows.

1) Amount of liquid needed for printing one page In a configuration in which, e.g., an amount of liquid at which post-end printing is executable is constantly monitored during printing, if the remaining amount of a head tank becomes lower than the amount of liquid at which post-end printing is executable, the controller would determine that liquid cannot be discharged at that time and stop printing. To prevent such a situation, in this embodiment, the tolerance amount $V_{tol}$ is subtracted in advance from the threshold remaining amount $V_{EM}$.

In other words, depending on a recording mode or an environment, even when only dummy discharge is performed, the consumption amount (usage) of liquid by the dummy discharge during post-end printing might exceed the second threshold amount. For example, in a configuration in which the controller constantly monitors the consumption amount of liquid by dummy discharge during printing and determines the end of post-end printing, if the consumption amount of liquid by dummy discharge exceeds the second threshold amount during printing a sheet, the post-end printing might be finished without printing the sheet completely. Hence, a threshold amount is set so that printing on the first sheet can be completed even if post-end printing ends during printing a second sheet.

2) Margin A predetermined amount is subtracted in advance as a margin to secure stable discharge.

To stably perform dummy discharge and maintenance during post-end printing, the remaining amount of liquid $V_{HT}$ remaining in the head tank 35 is, preferably, sufficiently greater than the threshold remaining amount $V_{EM}$ required for dummy discharge operation in the post-end printing.

Note that, if the remaining amount of liquid $V_{HT}$ remaining in the head tank 35 is smaller than the threshold remaining amount $V_{EM}$ required for dummy discharge operation in the post-end printing, liquid discharge (dummy discharge) would not be performed during post-end printing. As a result, an abnormal image might be output when normal printing is performed after replacement of the main tank 10. Additionally, maintenance might be needed to recover an abnormal state, causing a failure, such as an increase in wasteful liquid consumption or waiting time.

Figure 17:
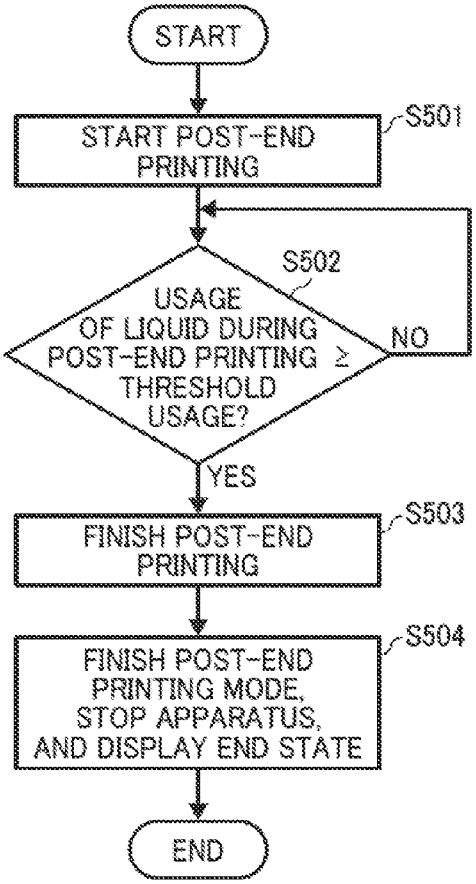
FIG. 17 is a flow chart of a first example of a post-end printing process of FIG. 15.

Next, a first example of the post-end printing process is described with reference to FIG. 17. FIG. 17 is a flow chart of the first example of the post-end printing process.

When the post-end printing process starts, at S501 the controller 500 starts post-end printing and, as described above, continues printing using liquid of a head tank 35 other than a head tank 35 corresponding to a main tank 10 in the end state.

For the head tank 35 corresponding to the main tank 10 in the end state, at S502 the controller 500 determines whether the usage of liquid used to maintain nozzle conditions by, e.g., dummy discharge or maintenance during the post-end printing is a threshold usage or greater. Note that the threshold usage is the above-described threshold remaining amount (second threshold amount).

When the consumption amount of liquid during post-end printing is the threshold usage or greater (YES at S502), at S503 the controller 500 finishes the post-end printing. At S504, the controller 500 finishes the post-end printing mode, stops the image forming apparatus 1000, and displays (notifies) the end state on, e.g., the control panel 514 serving as a notifier to prompt replacement of the main tank 10 (cartridge).

In other words, after the process shifts to the post-end printing mode, the controller 500 prohibits discharge for printing using liquid of a color in the end state and permits only dummy discharge and maintenance to perform minimum maintenance of nozzle conditions.

At this time, the controller 500 records the amount of liquid used for dummy discharge and maintenance as a usage of liquid during post-end printing. During printing, the controller 500 monitors the usage of liquid during post-end printing and the threshold usage (second threshold amount) and determines whether post-end printing is executable.

Note that the monitoring of the usage of liquid and the threshold usage during post-end printing may be, for example, constant monitoring or monitoring per one scanning or page, and the unit of monitoring is not particularly specified. The usage of liquid during post-end printing is stored onto, for example, the NVRAM 504.

With such a configuration, printing can be continued while the remaining amount of liquid is the amount of liquid at which post-end printing is executable. Accordingly, urgent printing can be continued until a user replaces a main tank (cartridge) in the end stage. Additionally, by monitoring the consumption of liquid, the controller can prompt a user to replace the main tank (cartridge) before the negative pressure in a head tank rises and a nozzle failure occurs.

Figure 18:
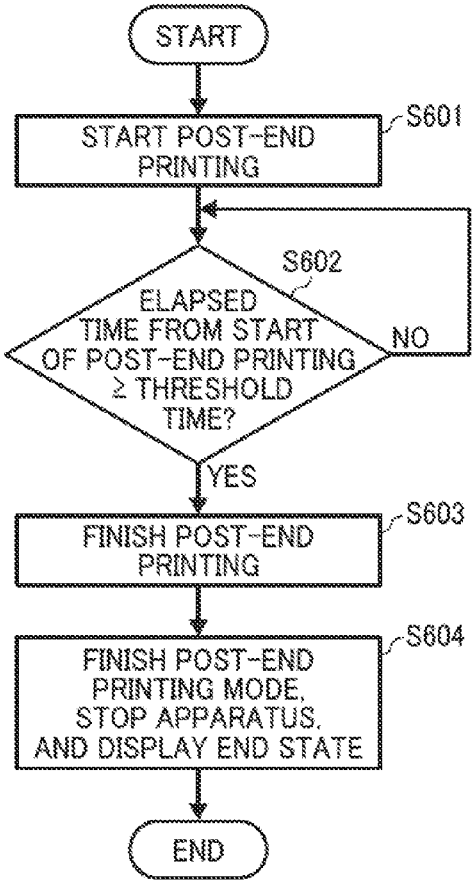
FIG. 18 is a flow chart of a second example of the post-end printing process.

Next, a second example of the post-end printing process is described with reference to FIG. 18. FIG. 18 is a flow chart of the second example of the post-end printing process.

When the post-end printing mode starts, at S601 the controller 500 starts post-end printing. At S602, the controller 500 determines whether an elapsed time period from the start of the post-end printing is a predetermined threshold time period or greater.

When the elapsed time period from the start of the post-end printing is the threshold time period or greater (YES at S602), at S5603 the controller 500 finishes the post-end printing. At S604, the controller 500 finishes the post-end printing mode, stops the image forming apparatus 1000, and displays the end state on, e.g., the control panel 514 to prompt replacement of the main tank 10 (cartridge).

In other words, like the post-end printing process described in the above-described second embodiment, after the process shifts to the post-end printing mode, the controller 500 prohibits discharge for printing using liquid of a color in the end state and permits only dummy discharge and maintenance to perform minimum maintenance of nozzle conditions.

At regular timings, such as before printing, during printing, after printing, when the image forming apparatus is powered on, before maintenance, and after maintenance, the controller monitors whether the elapsed time from when the process shifts to the post-end printing is a threshold time period (for example, a specified date and time) or greater.

Only minimum dummy discharge and maintenance are performed during post-end printing. If such a state continues over a long period of time, an abnormal image is likely to be output after cartridge replacement. To prevent such a failure, in this example, the controller 500 sets a time limit and stops permission of the post-end printing when the elapsed time from the start of the post-end printing exceeds the threshold time period.

Note that the time (date and time) of the start of the post-end printing is stored onto the NVRAM 504.

With such a configuration, printing can be continued while the remaining amount of liquid is the amount of liquid at which post-end printing is executable. Accordingly, urgent printing can be continued until a user replaces a main tank (cartridge) in the end stage. Additionally, by monitoring the elapsed time from when the process shifts to the post-end printing, the controller can prompt a user to replace the main tank (cartridge) before nozzle abnormality, e.g., a nozzle failure due to thickening of liquid in nozzles occurs.

Figure 19:
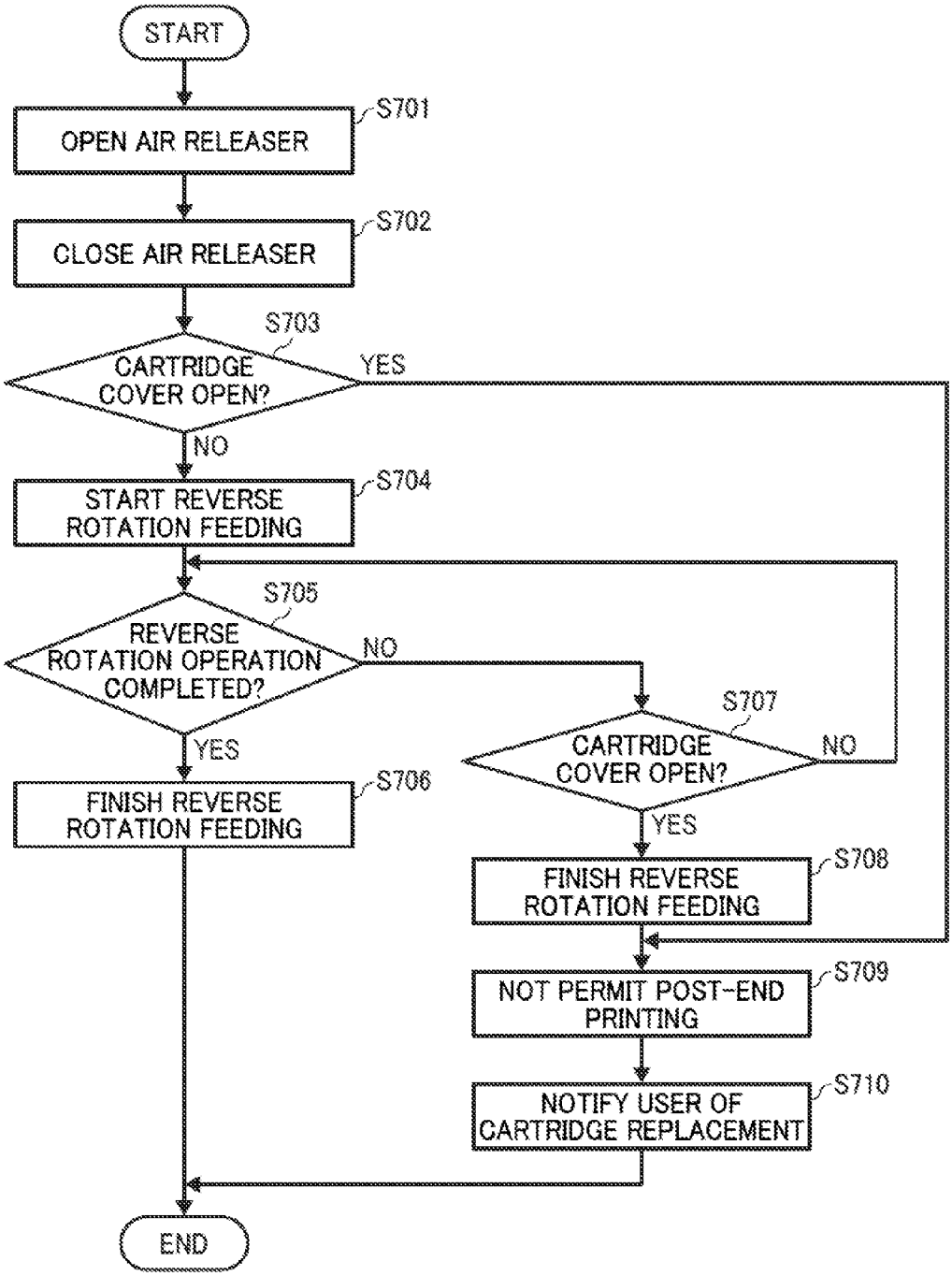
FIG. 19 is a flow chart of a reverse feeding process (first control process) according to a second embodiment of this disclosure.

Next, a reverse feeding process (first control process) according to a second embodiment of this disclosure is described with reference to FIG. 19. FIG. 19 is a flow chart of the reverse feeding process in the second embodiment.

In this embodiment, when the reverse feeding process starts, at S701 the air releaser 207 of the head tank 35 is opened. After the inside of the head tank 35 is opened to an ambient atmosphere to release the negative pressure, at S702 the air releaser 207 is closed.

At S703, the controller 500 checks the cartridge-cover sensor 574 and determines whether the cartridge cover 104 is open.

When the cartridge cover 104 is open (YES at S703), at S709 the controller 500 does not permit post-end printing and at S710 prompts a user to replace a main tank (cartridge) 10. Thus, the reverse feeding process ends.

By contrast, when the cartridge cover 104 is not open (NO at S703), like the above-described first embodiment, at S704 the liquid feed pump 241 is driven for reverse rotation to feed a threshold amount (first threshold amount) of liquid in reverse from the head tank 35 to the main tank 10 to release the negative pressure in the liquid feed pump 241 and the pressure detector 571.

At S705, the controller 500 determines whether the reverse rotation operation is completed.

When the reverse rotation operation is completed (YES at S705), at S706 the controller 500 stops driving of the reverse rotation of the liquid feed pump 241 to finish the reverse rotation feeding (reverse feeding). Thus, the reverse feeding process ends.

When the reverse rotation operation is not completed (NO at S705), at S707 the controller 500 determines whether the cartridge cover 104 is open.

When the cartridge cover 104 is not open (NO at S707), the controller 500 returns to S705 and determines whether the reverse rotation operation is completed.

By contrast, when the controller 500 detects that the cartridge cover 104 is open before the reverse rotation operation is completed (YES at S707), the controller 500 finishes the reverse rotation feeding at S708, does not permit post-end printing at S709 and prompts a user to replace a main tank (cartridge) 10 at S710. Thus, the reverse feeding process ends.

In other words, in the reverse feeding process (first control process) to feed liquid in reverse from the head tank 35 to the main tank 10 on detection of the end state, when the controller 500 determines that the post-end printing is not executable, the controller 500 does not shift to the post-end printing control process (second control process) and displays (notifies) a prompt for cartridge replacement on, e.g., the control panel 514.

Depending on the conditions in the image forming apparatus 1000, post-end printing may not be executable.

For example, if the cartridge cover 104 is opened before or during the reverse rotation feeding, the main tank 10 might be removed from the cartridge holder 4 and liquid might be ejected. Hence, the controller 500 stops reverse rotation of the liquid feed pump 241.

In such a case, since the reverse rotation of the liquid feed pump 241 has not been performed normally, the negative pressure in the liquid feed pump 241 and the pressure detector 571 may not be released. Therefore, the controller 500 does not permit post-end printing.

When the cartridge cover 104 is opened, the controller 500 also determines that the main tank 10 has been removed. Therefore, it is preferable to assume that air has been introduced into the liquid supply passage and perform a proper maintenance operation for recovering abnormality after cartridge replacement.

For example, normal rotation supply with the liquid feed pump 241 and suction with the suction cap 82*a* are alternately repeated to feed such air introduced into the liquid supply passage to the head tank 35 and eliminate bubbles.

As described above, even if the cartridge cover 104 is opened during the reverse feeding process, the controller 500 can treat the opening as an abnormal state. Accordingly, the controller 500, though cannot perform post-end printing, can perform proper maintenance after cartridge replacement to restore a normal state.

Figure 20:
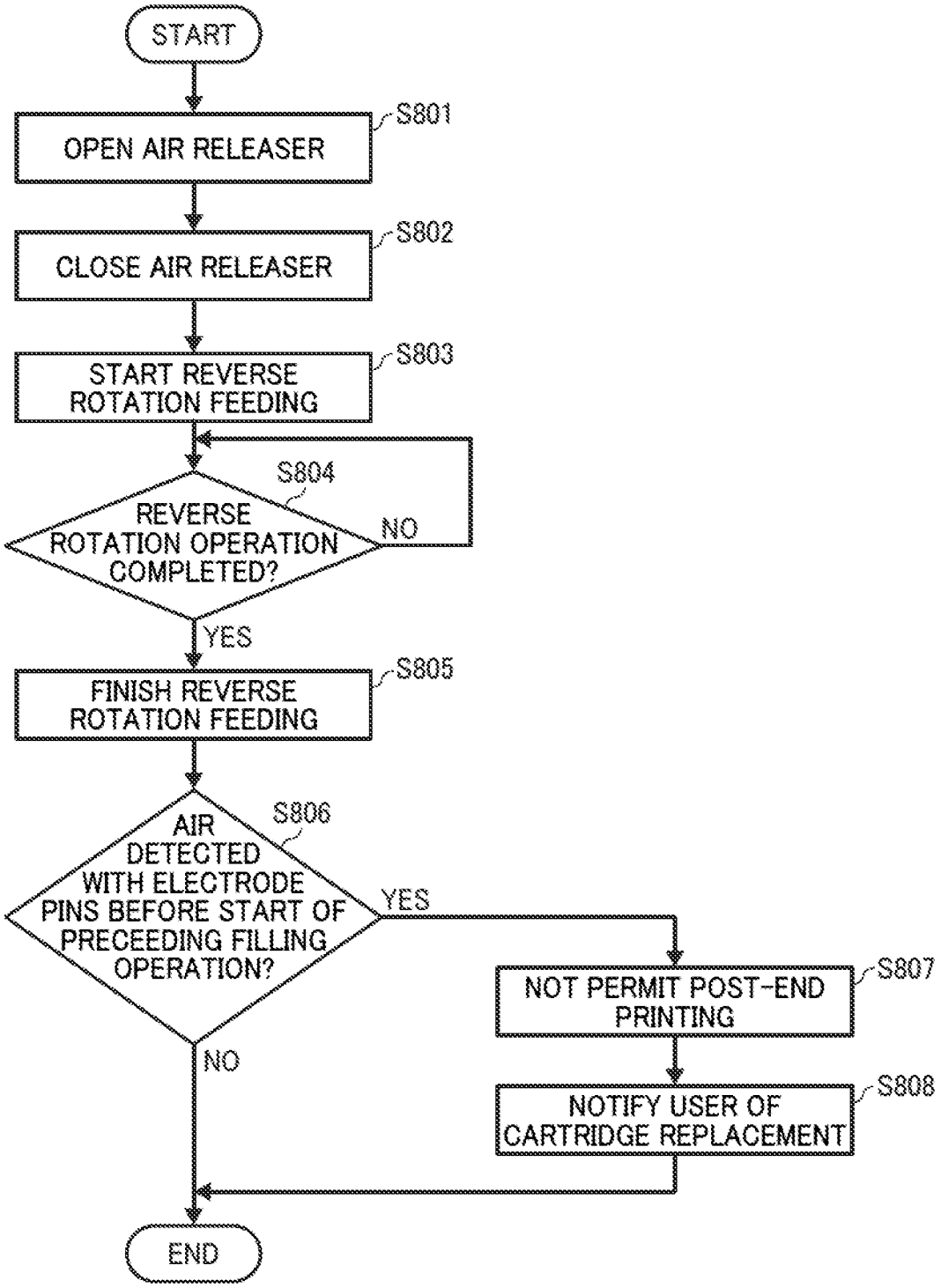
FIG. 20 is a flow chart of a reverse feeding process (first control process) according to a third embodiment of this disclosure.

Next, a reverse feeding process (first control process) according to a third embodiment of this disclosure is described with reference to FIG. 20. FIG. 20 is a flow chart of the reverse feeding process in the third embodiment.

In this embodiment, when the reverse feeding process starts, at S801 the air releaser 207 of the head tank 35 is opened. After the inside of the head tank 35 is opened to an ambient atmosphere to release the negative pressure, at S802 the air releaser 207 is closed.

At S803, like the above-described first embodiment, the liquid feed pump 241 is driven for reverse rotation to feed a threshold amount (first threshold amount) of liquid in reverse from the head tank 35 to the main tank 10 to release the negative pressure in the liquid feed pump 241 and the pressure detector 571.

At S804, the controller 500 determines whether the reverse rotation operation is completed. When the reverse rotation operation is completed (YES at S804), at S805 the controller 500 stops driving of the reverse rotation of the liquid feed pump 241 to finish the reverse rotation feeding (reverse feeding).

At S806, the controller 500 determines whether the electrode pins 208 has detected air before the start of the preceding filling operation.

When the electrode pins 208 has detected air (YES at S806), at S807 the controller 500 prompts a user to replace a main tank (cartridge) 10. Thus, the first control process ends.

When the electrode pins 208 has not detected air (NO at S806), the first control process directly ends.

In other words, when the electrode pins 208 has detected air before the start of the preceding filling operation, the volume of liquid $V_{fill}$ fully filled in the head tank 35 is not a proper full volume. Consequently, the relation of $V_{HT}>V_{EM}$ might not be satisfied.

In such a case, since liquid consumption by the threshold remaining amount $V_{EM}$ required for post-end printing cannot be secured, the controller 500 does not permit post-end printing.

Figure 21:
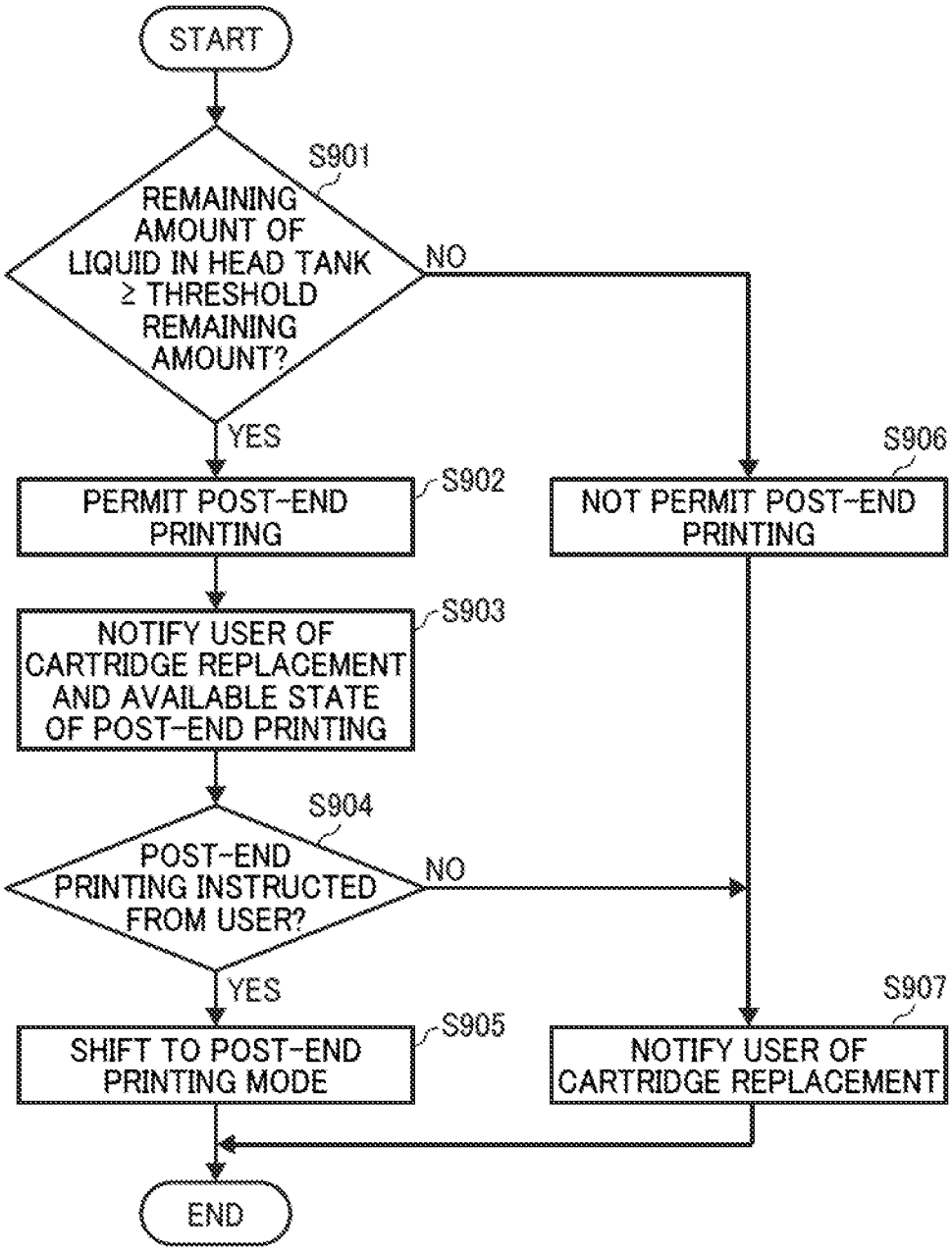
FIG. 21 is a flow chart of a post-end printing process according to a fourth embodiment of this disclosure.

Next, a control process according to a fourth embodiment of this disclosure is described with reference to FIG. 21. FIG. 21 is a flow chart of the control process in the fourth embodiment.

In this embodiment, after the reverse feeding process is performed, at S901 the controller 500 starts the post-end printing process (second control process) and determines whether the remaining amount of liquid in the head tank 35 is a threshold remaining amount or greater.

When the remaining amount of liquid is the threshold remaining amount or greater (YES at S901), at S902 the controller 500 permits post-end printing.

At S903, the controller 500 displays a prompt for cartridge replacement on, e.g., the control panel 514 and notifies a user that post-end printing is available.

At S904 the controller 500 determines whether post-end printing is instructed from a user. When post-end printing is instructed (YES at S904), at S905 the controller 500 shifts to a post-end printing mode. When post-end printing is not instructed (NO at S904), at S907 the controller 500 prompts the user to replace cartridges and finishes the post-end printing process.

When the remaining amount of liquid is smaller than the threshold remaining amount (NO at S901), at S906 the controller 500 does not permit post-end printing.

At S907, the controller 500 prompts the user to replace cartridges and finishes the post-end printing process.

Thus, a case in which the process cannot go to post-end printing can be reliably eliminated. By contrast, when the process goes to post-end printing, the user can securely select whether to perform the post-end printing or cartridge replacement.

In the above-described embodiments, post-end printing is described with examples in which printing is continued using liquid of a head tank(s) not in the end state, and liquid remaining in a head tank supplied from a main tank in the end state is used only for maintaining nozzle conditions. However, post-end printing may be applied to a case in which printing is performed using the liquid remaining in the head tank in the end state.

Programs causing a computer to execute control of the post-end printing executed by the controller in the above-described embodiments are stored in, e.g., the ROM 502.

For example, in this disclosure, the term "sheet" used herein is not limited to a sheet of paper and is anything to which liquid droplets can be attached. The term "sheet" is used as a generic term including a recorded medium, a recording medium, a recording sheet, and a recording sheet of paper. The terms "image formation", "recording", "printing", and "image printing" are used herein as synonyms for one another.

The term "image formation", which is used herein as a synonym for "recording" or "printing", includes providing not only meaningful images, such as characters and figures, but meaningless images, such as patterns, to the medium (in other words, the term "image formation" includes only causing liquid droplets to land on the medium).

The term "image" used herein is not limited to a two-dimensional image and includes, for example, an image applied to a three dimensional object and a three dimensional object itself formed as a three-dimensionally molded image.

The term "image forming apparatus" includes both serial-type image forming apparatus and line-type image forming apparatus.

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC) and conventional circuit components arranged to perform the recited functions.

The present invention can be implemented in any convenient form, for example using dedicated hardware, or a mixture of dedicated hardware and software. The present invention may be implemented as computer software implemented by one or more networked processing apparatuses. The network can comprise any conventional terrestrial or wireless communications network, such as the Internet. The processing apparatuses can compromise any suitably programmed apparatuses such as a general purpose computer, personal digital assistant, mobile telephone (such as a WAP or 3G-compliant phone) and so on. Since the present invention can be implemented as software, each and every aspect of the present invention thus encompasses computer software implementable on a programmable device. The computer software can be provided to the programmable device using any storage medium for storing processor readable code such as a floppy disk, hard disk, CD ROM, magnetic tape device or solid state memory device.

The hardware platform includes any desired kind of hardware resources including, for example, a central processing unit (CPU), a random access memory (RAM), and a hard disk drive (HDD). The CPU may be implemented by any desired kind of any desired number of processor. The RAM may be implemented by any desired kind of volatile or non-volatile memory. The HDD may be implemented by any desired kind of non-volatile memory capable of storing a large amount of data. The hardware resources may additionally include an input device, an output device, or a network device, depending on the type of the apparatus. Alternatively, the HDD may be provided outside of the apparatus as long as the HDD is accessible. In this example, the CPU, such as a cache memory of the CPU, and the RAM may function as a physical memory or a primary memory of the apparatus, while the HDD may function as a secondary memory of the apparatus.

What is claimed is:

1. An image forming apparatus, comprising:

a recording head including nozzles to discharge liquid droplets;

a head tank including a liquid containing part to contain liquid supplied to the recording head;

a main tank to contain the liquid supplied to the head tank; and a controller to control, after detection of an end state of the main tank, post-end printing using the liquid remaining in the head tank corresponding to the main tank in the end state, wherein the controller permits the post-end printing when an amount of the liquid remaining in the head tank to which the liquid is supplied from the main tank in the end state is a predetermined threshold remaining amount or greater.

2. The image forming apparatus according to claim 1, wherein the main tank is formed of at least two main tanks, and the controller controls the post-end printing to be performed using the liquid in at least one main tank of the at least two main tanks that is not in the end state.

3. The image forming apparatus according to claim 2, wherein, in the post-end printing, the controller controls the liquid remaining in the head tank corresponding to a main tank of the at least two main tanks that is in the end state to be used only for a maintenance operation of maintaining a performance of the nozzles.

4. The image forming apparatus according to claim 1, further comprising:

a liquid feeder disposed between the head tank and the main tank; and a pressure detector to detect pressure in a liquid supply passage from the main tank to the head tank, wherein, when the pressure in the liquid supply passage detected with the pressure detector in feeding the liquid from the main tank to the head tank is a threshold value or lower, the controller determines that the main tank is in the end state.

5. The image forming apparatus according to claim 4, further comprising an air releaser openable and closable to release an inside of the liquid containing part of the head tank to atmosphere, wherein the liquid feeder is a reversible liquid feeder, and when the controller determines that the main tank is in the end state, the controller opens the air releaser to release the inside of the liquid containing part of the head tank to the atmosphere and rotates the reversible liquid feeder in reverse to return the liquid from the head tank to the main tank by a predetermined amount.

6. The image forming apparatus according to claim 1, further comprising a notifier to notify that the controller permits the post-end printing.

7. The image forming apparatus according to claim 1, wherein the controller stops the post-end printing when a usage of the liquid in the head tank corresponding to the main tank in the end state is a threshold usage amount.

8. The image forming apparatus according to claim 1, wherein the controller stops the post-end printing when an elapsed time period from a start of the post-end printing reaches a threshold time period.

9. The image forming apparatus according to claim 1, wherein the controller controls printing in the post-end printing to be performed using the liquid remaining in the head tank corresponding to the main tank in the end state.

10. A non-transitory computer readable medium storing a program to cause a computer to execute a process for an image forming apparatus including a liquid discharge head including nozzles to discharge liquid droplets, a head tank including a liquid containing part to contain liquid supplied to the liquid discharge head, and a main tank to contain the liquid supplied to the head tank, the process comprising:

controlling, after detection of an end state of the main tank, post-end printing using the liquid remaining in the head tank corresponding to the main tank in the end state; and permitting the post-end printing when an amount of the liquid remaining in the head tank to which the liquid is supplied from the main tank in the end state is a predetermined threshold remaining amount or greater.

* * * * *